US009193191B2

(12) United States Patent
Sekino et al.

(10) Patent No.: US 9,193,191 B2
(45) Date of Patent: Nov. 24, 2015

(54) PRINTER

(71) Applicant: Toshiba Tec Kabushiki Kaisha, Tokyo (JP)

(72) Inventors: Toshiharu Sekino, Shizuoka (JP); Hiroyuki Taki, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 305 days.

(21) Appl. No.: 13/854,715

(22) Filed: Apr. 1, 2013

(65) Prior Publication Data

US 2013/0293655 A1 Nov. 7, 2013

Related U.S. Application Data

(60) Provisional application No. 61/619,353, filed on Apr. 2, 2012.

(51) Int. Cl.

| | |
|---|---|
| ***B41J 3/36*** | (2006.01) |
| ***B41J 13/02*** | (2006.01) |
| ***B41J 3/60*** | (2006.01) |
| ***B41J 15/04*** | (2006.01) |
| *B41J 11/70* | (2006.01) |

(52) U.S. Cl.

CPC .. *B41J 13/02* (2013.01); *B41J 3/60* (2013.01); *B41J 15/042* (2013.01); *B41J 11/70* (2013.01)

(58) Field of Classification Search

CPC ..... B41J 15/04; B41J 13/02; B41J 15/042; B41J 3/60; B41J 11/70; B65H 16/06

USPC ..... 347/101

See application file for complete search history.

(56) References Cited

U.S. PATENT DOCUMENTS

| | | | | |
|---|---|---|---|---|
| 5,764,263 | A * | 6/1998 | Lin | 347/101 |
| 7,708,360 | B2 | 5/2010 | Byerly et al. | |
| 2006/0266863 | A1* | 11/2006 | Takasu | 242/348 |
| 2011/0206439 | A1* | 8/2011 | Takahashi | 400/611 |

FOREIGN PATENT DOCUMENTS

| | | |
|---|---|---|
| JP | 2011-173621 | 9/2011 |
| JP | 2011-255681 | 12/2011 |

* cited by examiner

*Primary Examiner* — Julian Huffman

(74) *Attorney, Agent, or Firm* — Patterson & Sheridan, LLP

(57) ABSTRACT

A printer includes a housing, a drawer unit, first and second print medium supporting units, a third support, and a printing unit. The drawer unit is placed inside the housing so that it can be drawn out from the housing into open and closed positions. The first print medium supporting unit is fixed to the drawer unit and spaced apart from the second print medium supporting unit. The upper end of the second print medium supporting unit is fixed to the drawer unit and its lower end rotates with respect thereto. The third support is disposed in the housing and supports the lower end of the second print medium supporting unit when the drawer unit is in a closed position. The printing unit can print on a print medium pulled out from the rolled print medium which is rotatably supported by at least the first print medium supporting unit.

20 Claims, 4 Drawing Sheets

PRINTER

CROSS-REFERENCE TO RELATED APPLICATION

This application is based upon and claims the benefit of priority from U.S. Provisional Patent Application No. 61/619,353, filed on Apr. 2, 2012; the entire contents of which are incorporated herein by reference.

FIELD

Embodiments described herein relate generally to a printing apparatus, wherein a continuous sheet of printable material, for example paper, is supplied in roll form to a print region of the apparatus for performing printing thereon.

BACKGROUND

A housing of a printer, used to print on a paper pulled from a roll of paper, includes a box-shaped drawer unit which is slidable with respect to a housing to enable the loading of rolls of paper held in the drawer into the printer. A hopper is provided in or on the drawer unit to support the roll of paper so that the roll of paper may be rotated to allow paper to be fed therefrom for printing thereon.

The following problems arise if the roll of paper is positioned in the hopper in such a way that the lower end of the roll of paper comes into contact with the base or other surfaces of the drawer unit during printing. When the roll of paper is rotated to enable feeding of a continuous sheet of paper therefrom, sliding contact can occur between the lower end or extension of the roll of paper and the underlying surface of the drawer unit. When the roll is rotated to feed the paper therefrom, this contact generates heat from the rubbing of the paper against the adjacent surface, and due to this heat, a heat-sensitive roll of paper becomes blackened or darkened. Additionally, the paper fed from roll of paper may have scratches thereon due to the contact between the lower end of the roll of paper and the lower surface of the drawer unit. That is to say, if the roll of paper is set in such a way that the lower end of the roll of paper comes in contact with the adjacent surfaces of the drawer unit below the paper, it is difficult to effectively maintain the quality or integrity of the paper fed from the roll.

To effectively maintain the quality of the paper and the roll of paper, in the conventional printer, the roll of paper is positioned, when loaded into the drawer, in such a way that the lower end of the roll of paper lies above the base of the drawer unit so as to separate the roll of paper from the inner surfaces of the drawer unit below the roll. That is to say, in the conventional printer, the hopper is set in such a way that the lower end of the roll of paper lies at a position which is elevated off the surfaces of the drawer unit located therebelow.

However, the size of a roll of paper that can be loaded into the printing apparatus, and thus the length of paper which may be printed on before the roll must be replaced, is limited by the required clearance between the top of the roll and the drawer opening during loading of the paper into the printing apparatus. In a conventional printer of this type, arises when a roll of paper with a large diameter, which is sufficiently large to protrude into the upper portion of the drawer unit, is placed in the hopper the roll of paper and the housing of the printer can interfere with each other, when the drawer unit is pushed into the housing. Thus, the size of the roll is limited to a diameter which is less than the distance between the base of the drawer and the top of the opening into which the drawer slides, because the roll must be held above the base of the drawer to prevent deterioration of the paper during use. Therefore, in a conventional printer with rolls of paper possessing a small diameter placed in the hopper and which do not protrude into the upper portion of the drawer unit, the roll of paper is consumed quickly and thus the frequency of roll replacement is high.

DETAILED DESCRIPTION

Figure 1:
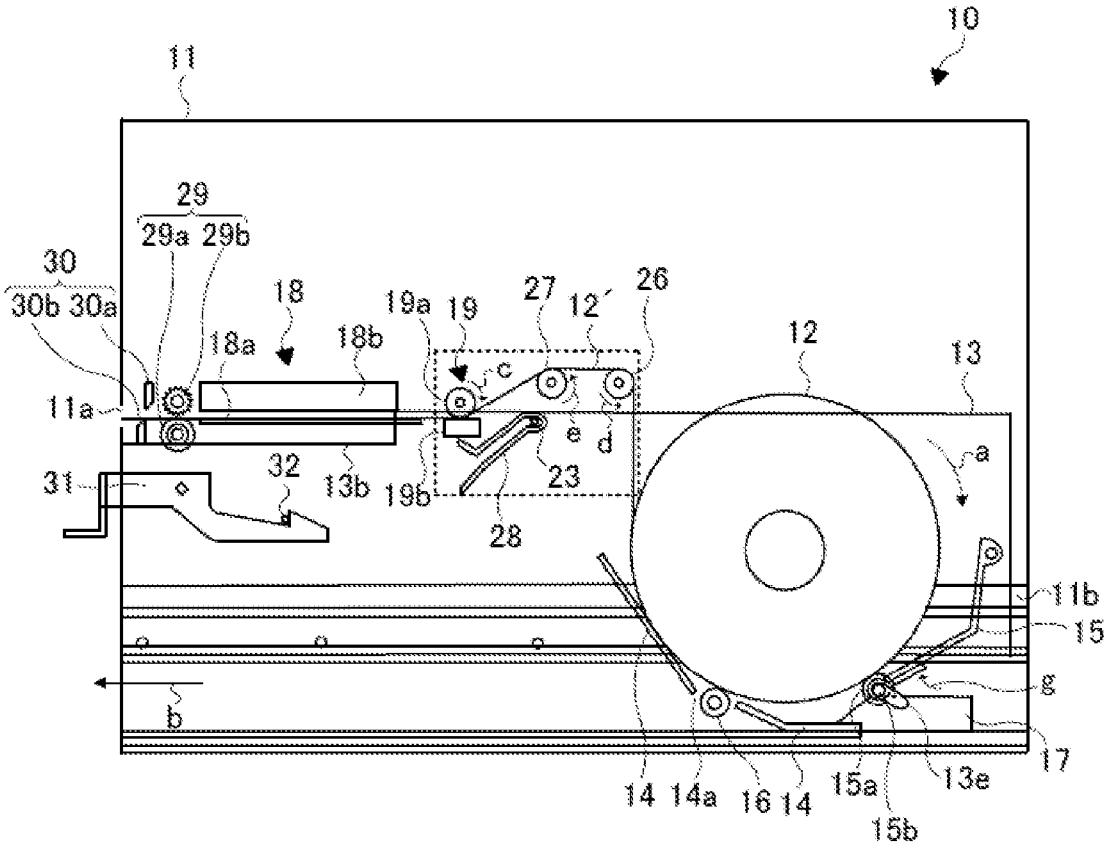
FIG. 1 is a schematic configuration showing a printer, according to an embodiment.

In general, embodiments of the invention provide a printer that can effectively maintain the quality of a rolled print medium while enabling use of an enlarged diameter of the rolled print medium, and thus increase the length of paper that can be used in the printing apparatus before the roll must be replaced. FIG. 1 is a schematic configuration showing a printer according to this embodiment. In the embodiment, the roll of paper is loaded into the hopper in a position where the lowermost surface of the roll is in contact with the base of the drawer, but, after the roll has passed the underside of the opening of the housing within which the drawer slides, the roll is lifted off of the base of the drawer. Thus, a larger roll of paper may be accommodated, but deterioration of the paper caused by rubbing of the paper against the base of the drawer is eliminated.

A printer 10 as shown in FIG. 1, has a rolled print medium, formed by winding a print medium into a roll, which can be set inside a housing 11 and a print operation can be performed on both sides of the print medium as it is pulled from the roll of print medium. In the following, a roiled print medium is shown as rolled paper 12 and a print medium is shown as a strip of paper 12'.

According to an embodiment of the invention, a printer includes a housing having an outlet, a drawer unit, a first print medium supporting unit, a second print medium supporting unit, a support, and a printing unit. The drawer unit is locatable inside the housing on a slide such a way that it can be pulled outwardly from the housing for loading of the rolled paper 12 therein. The first print medium supporting unit is fixed to the drawer unit. The second print medium supporting unit is placed at a position which is separated from that of the first print medium supporting unit and the upper end thereof is fixed to the drawer unit and along with that its lower end is set in such a way that it moves with respect to the drawer unit. The above mentioned printing unit can print on the beltshaped print medium pulled out from the rolled print medium, which is supported during rotation thereof to feed the print medium 12' in such a way that it can rotate with the help of at least the first print medium supporting unit.

The housing 11 includes a print medium support unit which comprises the hopper that supports the rolled paper 12 in such a way that the rolled paper 12 can rotate in the direction shown by the arrow 'a' in the drawing; a feed unit that feeds the strip of paper 12' pulled out from the rolled paper 12 to a printing unit; and a printing unit that performs printing operation on the strip of paper 12' pulled out from the rolled paper 12 inside it. Moreover, the hopper is set in a drawer 13 slidable in the housing 11 in such a way that the drawer 13 can be pulled out of the housing 11 in the direction 'b'. (For example, the direction of the arrow 'b' in the drawing is referred to as front or opening direction. And, the direction opposite to the direction of the arrow 'b' in the drawing is referred to as reverse or closing direction.) In the upper direction of the housing 11, there is a drawer unit 13, which is box-shaped member having the hopper and an open top through which the rolled paper 12 maybe placed into the hopper. The drawer unit 13 is set up in such a way that it can be moved into and out of the housing 11 using rails 11*b*. The rails 11*b* extend along the base of the housing 11.

The print medium support unit includes a hopper front guide 14 and a hopper rear guide 15 which together form the front and back of the hopper. The hopper front guide 14 and the hopper rear guide 15 are fixed to the drawer unit 13. The hopper front guide 14 and the hopper rear guide 15 face each other and have an open space, formed between them, which widens from the bottom to the top of the hopper. The rolled paper 12 is placed in the open space formed between guides 14 and 15.

The front guide 14 includes a lower end connected to the lower surface of the drawer unit 13 and a part extending from the lower end of the drawer unit 13 and toward the front of the drawer 13.

Furthermore, the hopper front guide 14 includes opening 14*a*. A hopper front roller 16 is set up in this opening 14*a*. The paper roll 12 may easily roll on the hopper front roller 16, which supports the rolled paper 12 off the front guide 14, to prevent contact between the rolled paper 12 and the hopper front guide 14.

The upper end of the hopper rear guide 15 is pivotably fixed to the drawer unit 13, and extends in the direction of the base of the drawer 13 and the front of the housing, such that the lower end thereof can swing or move within the drawer unit 13. The hopper rear guide 15 also contains a hopper rear roller 15*a*, which supports a second location on the underside of the print medium rolled paper 12. The rear roller 15*a* is, in use, positioned on a short wall 17 connected to, and extending from, the base of the housing as best shown in FIG. 5.

Figure 2:
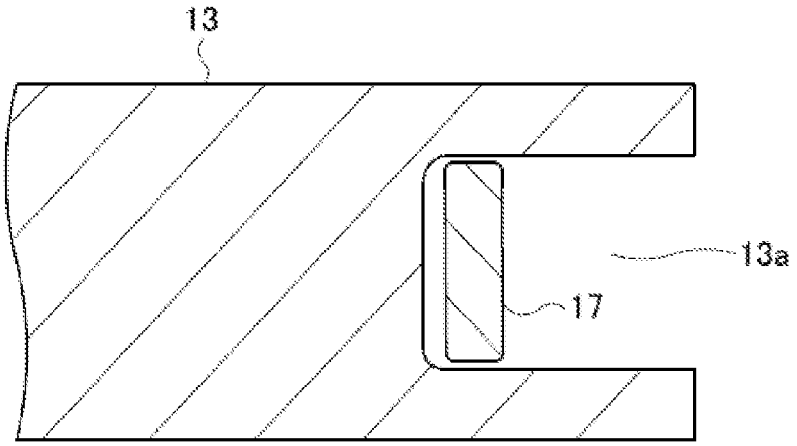
FIG. 2 is a diagram showing the positional relationship between a drawer unit and a third print medium supporting unit, according to an embodiment.

Referring now to FIG. 2, a first opening 13*e* extends into the lower drawer unit 13, and the rotation support unit 15*b* extends over the first opening 13*e* (FIG. 2) while supported at its opposed ends in the drawer unit. The opening 13*a* allows the rear end of the drawer unit 13 to move over and past the short wall 17 against which the roller 15*a* is supported during use of the printing apparatus, and thus the hopper rear roller 15*a* moves along the first opening 13*e*.

The roller 15, and roller support unit 15*b*, can move upwardly and downwardly within the first opening 13*e* when the e drawer unit 13 moves with respect to the short wall as the roller 15*a* and support unit 15*b* engage against the inclined surface of the short wall 17.

Figure 5:
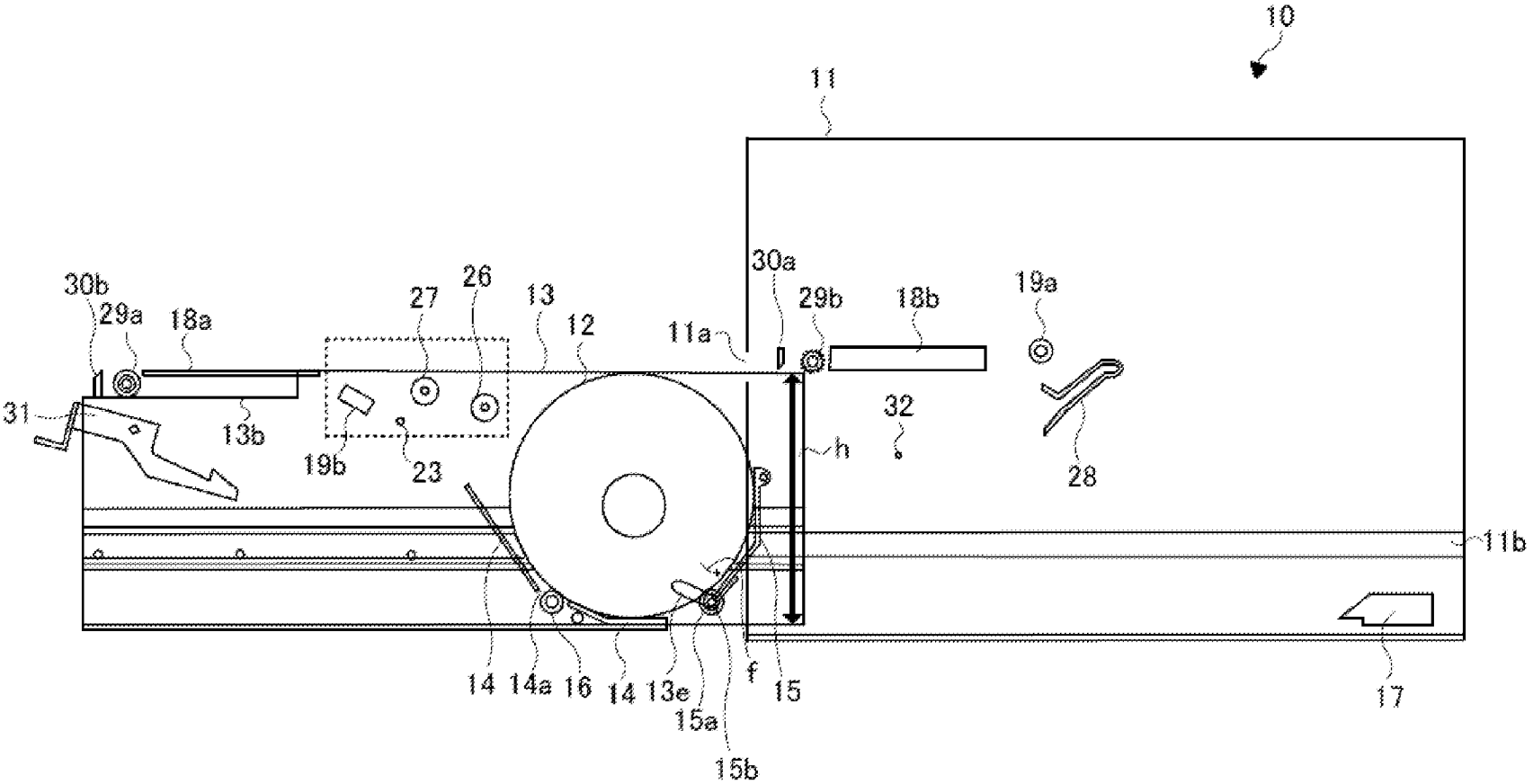
FIG. 5 is a schematic configuration showing the printer in a state where the drawer unit is pulled out from a housing of the printer, according to an embodiment.

As best shown in FIG. 5, the short wall 17 is configured to support the hopper rear roller 15*a* from the underside thereof. The upper surface of the support 17 is an inclined surface that inclines toward the rear end of the housing 11. As shown in FIG. 1, when the rear roller 15*a* engages the support 17, the rotation support unit 15*b*, which is positioned at the lower end of the rear guide 15, is positioned such that a surface of the roller 15*a* extends from the first opening 13*e* in the direction of the paper roll 12. In this position of the rear roller 15 the rolled paper 12 is lifted off the rear guide 15 in the direction of front guide 14 to prevent contact between the rolled paper 12 and the rear guide 15. Also, because the rear guide 15 is on a pivot, when the roller guide 15*b* engages shortwall 17, the extending portion thereof moves inwardly of the volume of the hopper (bounded by the fixed front guide 14 and the adjacent sidewalls of the drawer extending to the moveable rear guide), the volume of the hopper is at its minimum.

As will be explained later, when the hopper rear roller 15*a* is not positioned below on the support 17, the rotation support unit 15*b* at the back of the hopper rear guide 15 is positioned below the first opening 13*e*. Due to this, the volume of the open space of the hopper rear guide 15 and the hopper front guide 14 is at its maximum.

Referring again to FIG. 1, the printing unit that performs printing on the strip of paper 12' pulled out from the rolled paper 12 contains a first printing unit 18 that prints on the front surface of the strip of paper 12' and a second printing unit 19 that prints on the back surface of the strip of paper 12'. As the paper 12' is fed to the printing units 18, 19, the rolled paper 12 is supported in the above mentioned print medium supporting unit/hopper.

The first printing unit 18 is provided in the vicinity of the outlet 11*a* of the housing. This outlet 11*a* is located at one (front, with respect to the drawer front) side of the housing 11. The first printing unit 18 is a printing unit that performs the printing by the inkjet method on the surface of the strip of paper 12' and it contains a paper guide 18*a* and an inkjet head 18*b*.

The paper guide 18*a* is fixed to the drawer unit 13 and extends over a notch 13*b* in the drawer unit 13. This notch 13*b* is located in the upper front end of the drawer unit 13. Moreover, the strip of paper 12' moves over and becomes positioned on the upper surface of the paper guide 18*a*.

The inkjet head 18*b* is placed at the position which extends over and is located above the upper surface of the paper guide 18*a*, and also above the drawer unit 13 (when in the housing 11). The inkjet head 18*b* performs printing by the inkjet method on the strip of paper 12' located on the paper guide 18*a*.

The second printing unit 19 is located between the print medium supporting unit (when drawer unit 13 is in the closed position of FIG. 1) and the first printing unit 18 in the feeding track of the strip of paper 12'. The second printing unit 19 is a printing unit that performs the printing on the back surface of the strip of paper 12' by thermal type method and it contains a platen roller 19*a* and a thermal head 19*b*.

The platen roller 19*a* is secured to the housing 11 at a position which is roughly above the drawer unit 13. At the time of performing the printing by a thermal-type method, the thermal head 19*b* is pushed against the strip of paper 12' and thus the strip of paper the platen roller 19*a*.

The thermal head 19*b* is positioned immediately below or adjacent to the platen roller 19*a* when the drawer unit 13 is fully seated in the housing 11, such that it does not protrude above the drawer unit 13. The thermal head 19*b* performs printing on the strip of paper 12' by thermal type printing method.

Figure 3:
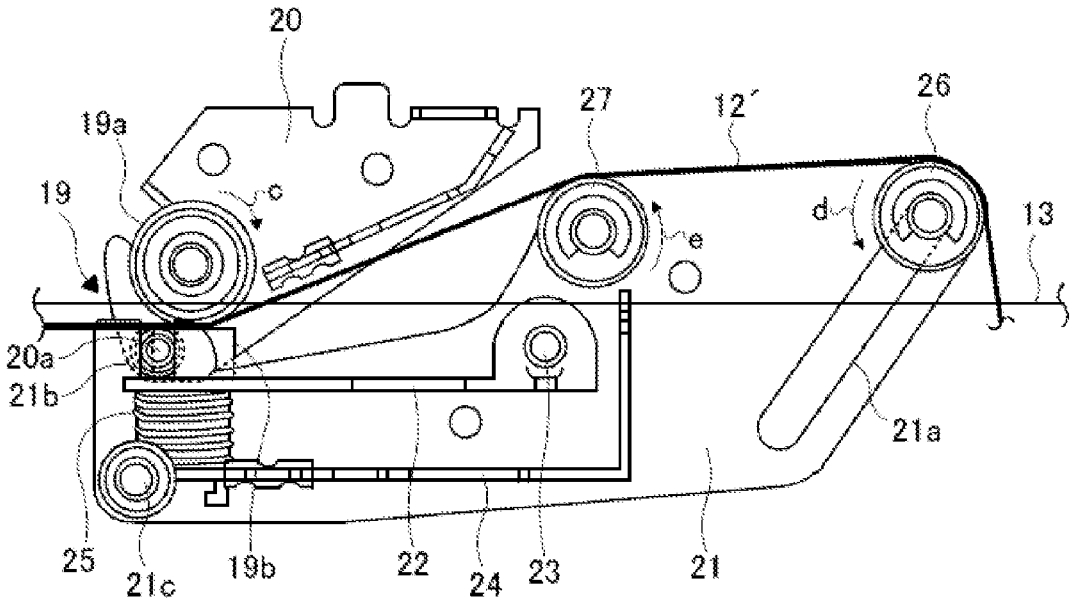
FIG. 3 is a diagram showing an enlarged portion of FIG. 1, marked with dotted lines, according to an embodiment.

FIG. 3 is a diagram showing an enlarged view of the marked with dotted line section of FIG. 1. It also shows the structure of the second printing unit 19 and the area thereabout. As shown in FIG. 3, the platen roller 19*a* is secured to the housing 11 by affixing it to a platen frame 20 which, in turn, is fixed to the housing 11, so that the platen roller 19*a* can rotate in the direction of the arrow 'c' shown in the drawing.

The thermal head 19*b* is fixed above one end of a head support 22 of a head block 21 supported in the drawer unit 13. The end of the head support 22 opposite to thermal head 19*b* is fixed to the head block 21 by a head support shaft 23, about which head block 21 may pivot. An L-shaped head frame 24 located below the head support 22. On one end of the L-shaped head frame 24 is positioned a compressed spring 25 which extends therefrom and engages the underside of head support 22 to bias the portion of head support 22 on which thermal head 19*b* is fixed in the direction of roller 19. The thermal head 19*b* pushes against the platen roller 19*a*, or paper against the roller 19*a*, using this spring force.

Moreover, the head block 21 is provided with a damper roller 26 and a guide roller 27 that feed are positioned to guide the strip of paper 12' entering the thermal printing region. The damper roller 26 can slide within an elongated hole 21*a* set up in the head block 21, and also rotate in the direction of the arrow 'd' shown in FIG. 3. Moreover, the guide roller 27 is secured in the head block 21 in such a way that it can rotate in the direction of the arrow 'e' shown in FIG. 3.

Furthermore, the head block 21 contains a notch 21*b* therein, adjacent to the position of the spring 25, to moveably secure it to the platen frame 20, such that the notch is moveable with respect to engagement shaft 20*a* secured on the platen frame 20, which is received in the notch 21*b*. As shown in the drawing, the engagement shaft 20*a* of the platen frame 20 is joined and set in the notch 21*b* of the head block 21 and thus, the head block 21 and the platen frame 20 are mutually engaged and the thermal head 19*b* is able to push against the platen roller 19*a*.

Figure 4:
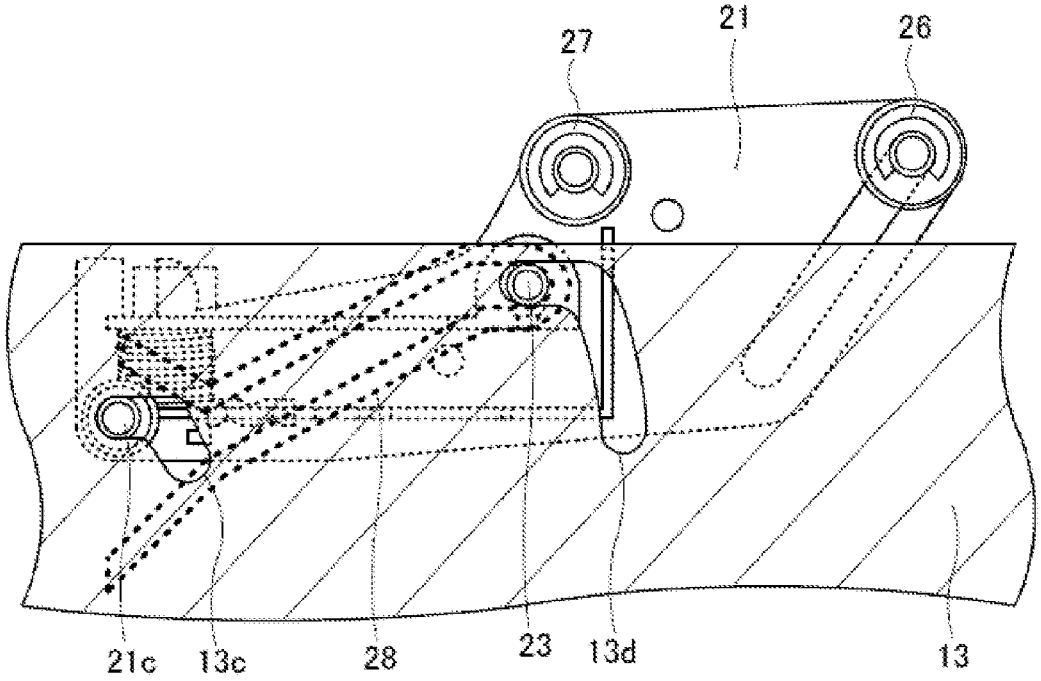
FIG. 4 is a diagram showing the relationship between a head block and the drawer unit, according to an embodiment.

FIG. 4 shows the relationship between the head block 21 and the drawer unit 13, and the features which allow relative movement thereof when desired. As shown in the FIG. 4, the head block shaft 21*c* is associated with the head block 21. Moreover, at one side of the drawer unit, a first elongated hole or short slot, 13*c* into which an end portion of the head block shaft 21*c* extends, and an second elongated hole 13*d* into which an end portion of the head support shaft 23 extends, are provided. The head block 21 positioned in the drawer unit 13 such that the head block shaft 21*c* can move in the second elongated hole 13*d* and the head support shaft 23 can move in the second elongated hole 13*d*.

When the drawer unit 13 is pushed to the housing 11, along with the movement of the drawer unit 13, the head support shaft 23 of the head block 21 moves in a direction from the left to the right of FIG. 4. When the drawer 13 is fully seated in the housing 11, the shaft 27 is positioned at the bottom right extremity of slot 13*d*. In that location, it is aligned with an opening in the generally U-shaped (with outwardly forced ends guide unit 28. As the drawer 13 is moved to the closed position in housing 11, the shaft 25 enters the open end of guide unit 28. As the drawer is closing, the head block shaft 21*c* moves to the upper end of the first elongated hole 13*c*, and the head support shaft 23 moves to the upper end of a second elongated hole 21*d*. Due to this movement, the component that includes the damper roller 26 and the guide roller 27 moves to a position above the top of the drawer 13, and the thermal head 19*b* pushes against the platen roller 19*a*.

Referring again to FIG. 1, a discharge roller 29 is set up between the first printing unit 18 and the outlet 11*a* of the housing 11. This discharge roller includes the portion of the feeding unit that feeds the strip of paper 12' to the outlet 11*a*. The discharge roller 29 includes a discharge roller 29*a* that rotates in the given direction due to the rotations of a motor and a pinch roller 29*b* which, in turn, rotates due to the rotation of the discharge roller 29*a*. The pinch roller 29*b* is fixed to the housing 11 and when the drawer unit 13 is closed into the housing 11, the discharge roller 29*a* is fixed to the drawer unit 13 in the position which is roughly in the opposite direction in which the pinch roller 29*b* is fixed.

The feeding unit includes the discharge roller 29; the damper roller 26 and the guide roller 27; and the platen roller 19*a* of the second printing unit 19. The platen roller 19*a* and the discharge roller 29*a* of the discharge roller 29 rotate in the given direction by the motor rotations respectively, and in turn, the damper roller 26 and the guide roller 27 rotate due to the rotations of the platen roller 19*a* and the discharge roller 29*a*.

In between the discharge roller 29 and the outlet 11*a* of the housing 11, a cutting portion 30 is provided to cut the strip of paper 12' as it leaves first printing unit 18. The cutting portion 30 has upper cutting blade 30*a* and lower cutting blade 30*b*. The upper cutting blade 30*a* on the cutter is held on the housing 11 and when the drawer unit 13 is placed inside the housing 11, the lower cutting blade 30*b* on the cutter is positioned in opposition to the upper cutting blade 30*a* on the cutter.

The printing 10 performs the printing as follows. For example, when a printing command is received from a CPU not shown in the drawing, the given printing is done by the thermal head 19*b* on the back surface of the strip of paper 12', which is placed in between the platen roller 19*a* and the thermal head 19*b* of the second printing unit 19.

The strip of paper 12', on the back surface of which the printing is completed, is fed over and along the upper surface of the paper guide 18*a* of the first printing unit 18 by the motion imparted thereto by the rotation of the platen roller 19*a*. In the first printing unit 18, printing is performed by an inkjet head 18*b* on the surface of the strip of paper 12', which is placed on the upper surface of the paper guide 18*a*.

The strip of paper 12', for which printing is completed on both surfaces, is discharged from the outlet 11*a* of the housing 11 by the discharge roller 29 and is cutting by the cut portion 30.

Figure 6:
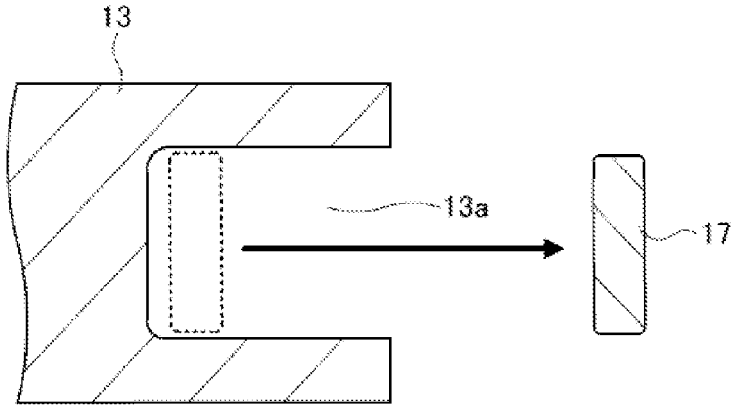
FIG. 6 is a diagram showing the positional relationship between the drawer unit and the third print medium supporting unit in a state where the drawer unit is pulled out from the housing of the printer, according to an embodiment.

FIG. 5 is a schematic configuration showing the printer 10 of this embodiment in a state where the drawer unit 13 is pulled out from the housing 11, and FIG. 6 is a diagram showing the positional relationship between the drawer unit 13, which is pulled out from the housing 11, and the short wall 17. Moreover, FIG. 7 is a diagram showing an enlarged view of the portion of FIG. 5, marked with dotted lines, and it also shows the relationship between the head block 21 and the drawer unit 13.

In the above mentioned printer 10, if a hook arm 31 set in the drawer unit 13 is unfastened from a lock unit 32 which is set in the housing 11; the drawer unit 13 may be pulled out from the housing 11. In this case, only the short wall 17, which is fixed to the housing 11, remains inside the housing 11 (FIG. 5 and FIG. 6) and along with the drawer unit 13, each component that is set up in the drawer unit 13 is pulled out from the housing 11 (FIG. 5).

Figure 7:
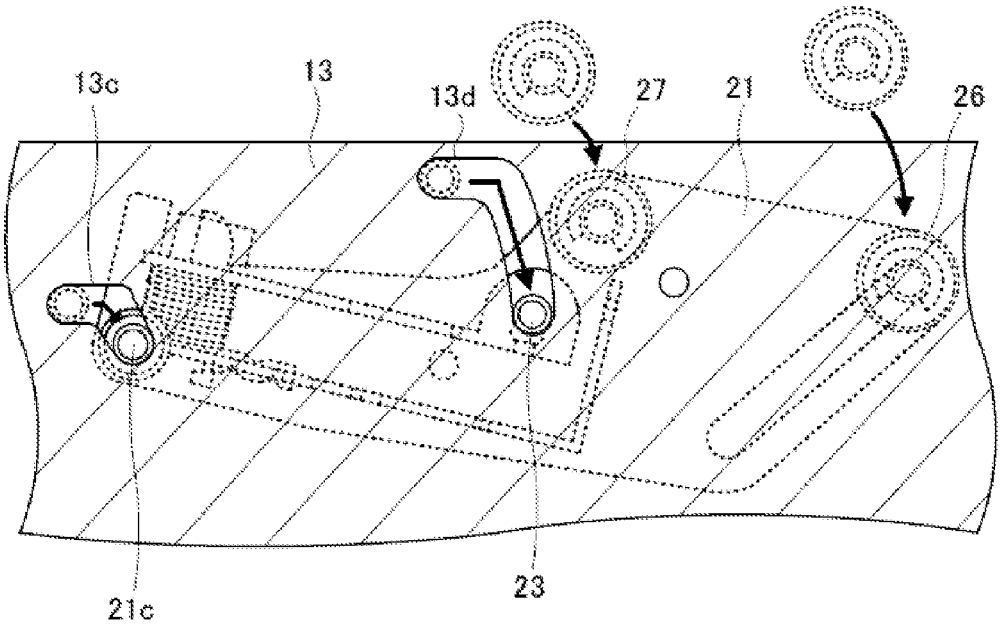
FIG. 7 is a diagram showing an enlarged portion of FIG. 5, marked with dotted lines, according to an embodiment.

As shown in FIG. 7, along with the movement of this drawer unit 13 in the outward direction from the housing 11 (the movement of the front portion of the drawer unit 13), the head support rotating shaft 23 of the head block 21 moves in the guide unit 28 (FIG. 5) to and ultimately separates from the guide unit 28. Due to this, the head block 21 which was supported by a flared end of the guide unit 28, moves to a lower position; the head block rotating shaft 21*c* moves to the lower end of the first elongated hole 13*c* of the drawer unit 13, and the head support rotating shaft 23 moves to the lower end of the second elongated hole 13*d* of the drawer unit 13. Thus, the head block 21, which contains the damper roller 26 and the guide roller 27, moves to the position which does not extend from the top of the drawer unit 13. That is to say, the head block 21 is moved to such a position that it cannot interfere with the inkjet head 18*b* as the drawer unit 13 is pulled out from the housing 11, or as the drawer unit 13 is pushed into the housing 11.

As shown in FIG. 5, as the drawer unit 13 is pulled out, the hopper rear roller 15*a* slides on the inclined surface of the short wall 17 and the rotation support unit 15*b*, set at the lower end of the hopper rear guide 15, moves to the lower end of the first opening 13*e*. That is to say, when the drawer unit 13 is pulled out, the hopper rear guide 15 starts rotating in the direction of the arrow 'f' in the drawing, taking the upper end as a center. Due to this, the volume of the open space formed between the hopper rear guide 15 and the hopper front guide 14 is increased.

If the rolled paper 12 is located in this larger open space, the rolled paper 12 is supported by the hopper front guide 14 on roller 14*a* and on the hopper rear guide 15. In this case, the lower most surface of the rolled paper 12 contacts the lower surface of the drawer unit 13 as shown in FIG. 5. As a larger diameter of the rolled paper 12 may be accommodated, so long as the diameter of the roll is equal to or less than the inner height of the drawer 13, in which case there is no protrusion of the rolled paper 12 in the upper direction from the drawer unit 13.

After arranging the rolled paper 12 of such large diameter in the hopper region of the drawer, the drawer unit 13 is pushed to the housing 11. In this operation, as the drawer unit 13 is moved inside the housing 11, the hopper rear roller 15*a* also moves therewith. In this operation, since the upper portion of the rolled paper 12 does not protrude from the drawer unit 13 in the upper direction, interference between the rolled paper 12 and the housing 11 or elements extending therefrom is prevented.

As the drawer unit 13 is moved into the housing 11 after the hopper rear roller 15*a* is moved up to the position that it comes in contact with the inclined surface of the shortwall 17 fixed inside the housing 11, as shown in FIG. 1; the hopper rear roller 15*a* thus ascends and slides along the inclined surface of the shortwall 17 and becomes located on the shortwall 17. Due to this, the hopper rear guide 15 starts swinging in the direction of arrow 'g' shown in FIG. 1, pivoting about its the upper end. Thus, the volume of the open space formed between the hopper rear guide 15 and the hopper front guide 14 is reduced. Then, the hopper rear roller 15*a* of the hopper rear guide 15 moves the rolled paper 12 in the upper direction, and the lower end A of the rolled paper 12 is also separated from the hopper front guide 14 that comes in contact with the drawer unit 13.

According to an embodiment of the printer explained above, in a state where the drawer unit 13 is pulled out from the housing 11, the rolled paper 12 is set in between the hopper front guide 14 and the hopper rear guide 15 is arranged in such a way that its lower end A comes in contact with the lower surface of the drawer unit 13 through the portion of the hopper front guide 14. Therefore, even if the rolled paper 12 having the large diameter D, which is the same in extent with the height 'h' of the drawer unit 13, is placed in between the hopper front guide 14 and the hopper rear guide 15, the protrusion of the rolled paper 12 to the upper direction from the drawer unit 13 is prevented. As a result, there is no interference between the rolled paper 12 and the housing 11, and the drawer unit 13 can be placed inside the housing 11.

If the drawer unit 13 is placed inside the housing 11, the hopper rear roller 15*a* is arranged on the shortwall 17 which supports the rear roller above its "free state" position, i.e., above its position when the drawer 13 is open. As a result, the hopper rear roller 15*a* moves the rolled paper 12 in the upper direction and the lower end of the rolled paper 12 is separated from the lower, drawer bottom engaging portion of the hopper front guide 14. Therefore, even if the rolled paper 12 is rotated, the quality of the rolled paper 12 can be maintained well as it does not slide or rub on front or rear guides 14, 15.

That is to say, according to an embodiment of the printer, the quality of the rolled paper 12 can be well maintained while the diameter of the rolled paper 12 can be increased.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer comprising:

a housing provided with an outlet;

a drawer unit slidable in the outlet between an open position and a closed position;

a first print medium supporting unit disposed in the drawer unit;

a second print medium supporting unit spaced apart from the first print medium supporting unit, with an upper end being fixed to the drawer unit and a lower end being moveable between a first position and a second position higher than the first position relative to a bottom of the drawer unit;

a support unit fixed to the housing that comes into contact with the lower end of the second print medium supporting unit so that the lower end of the second print medium supporting unit is moved from the first position to the second position when the drawer unit is moved to the closed position, wherein the support unit does not contact the second print medium supporting unit when the drawer unit is in the open position; and a printing unit configured to print on a print medium extending from a rolled print medium that is rotatably supported by at least the first print medium supporting unit.

2. The printer according to claim 1, further comprising:

a print medium supporting roller provided at the lower end of the second print medium supporting unit;

a rotation support unit at the lower end of the second print medium supporting unit that supports the print medium supporting roller; and a first opening placed in the rotation support unit is provided on a side surface of the drawer unit, wherein the print medium supporting roller supports the rolled print medium when the drawer unit is in the dosed position.

3. The printer according to claim 2, wherein the support unit positions the second print medium supporting unit and the print medium supporting roller into contact with the rolled print medium when the drawer unit is in the closed position.

4. The printer according to claim 1, wherein
a side surface of the support unit is an inclined surface.

5. The printer according to claim 1, wherein
the support unit is fixed to a lower surface of the housing.

6. The printer according to claim 1, wherein
the drawer unit is provided with a second opening that exposes the support unit in the drawer unit.

7. The printer according to claim 1, wherein
the printing unit comprises:
a first printing unit that prints on a front surface of the print medium; and
a second printing unit that prints on a back surface of the print medium.

8. The printer according to claim 7, wherein
the second printing unit comprises a thermal head disposed on the drawer unit, and
the first printing unit comprises an inkjet head disposed in the housing.

9. The printer according to claim 8, wherein
the second printing unit is provided between the first printing unit and the outlet of the housing.

10. The printer according to claim 9, wherein
a cut portion, which cuts the print medium, is provided between the first printing unit and the outlet of the housing.

11. A printing apparatus for supporting rolled print medium in a printer, the printing apparatus comprising:
a housing having an outlet;
a drawer unit slidable through the outlet between an open position and a closed position;
a first supporting unit disposed in the drawer unit and configured to support the rolled print medium when the drawer unit is in the open position;
a second supporting unit disposed in the drawer unit, with an upper end and a lower end, wherein the upper end is attached to the drawer unit and the lower end is moveable relative to the drawer between a first position and a second position higher than the first position relative to a bottom of the drawer unit, and wherein the lower end is in the first position when the drawer unit is in the open position and the lower end is in the second position when the drawer unit is in the closed position; and
a printing unit configured to print on a print medium fed from the rolled print medium.

12. The printing apparatus according to claim 11, further comprising:
a first roller disposed on a lower portion of the first supporting unit configured to support the rolled print medium; and
a second roller disposed on the lower end of the second supporting unit configured to support the rolled print medium when the drawer unit is in the closed position.

13. The printing apparatus according to claim 12, further comprising:
a third supporting unit configured to contact and rotate the lower end of the second supporting unit from the first position to the second position when the drawer unit moves from the open position to the closed position, wherein the rotation places the second roller into contact with the rolled print medium.

14. The printing apparatus according to claim 11, wherein the printing unit further comprises:
a first printing unit configured to print on a front surface of the print medium; and
a second printing unit configured to print on a back surface of the print medium.

15. A method for printing on a rolled print medium in a printer, the method comprising:
loading the rolled print medium into a drawer unit extending from a housing of the printer in an open position so that the rolled print medium is supported on a first supporting unit fixed to the drawer unit and on a second supporting unit having a first end fixed to the drawer unit and a second end moveable between a first position and a second position higher than the first position relative to a bottom of the drawer unit;
moving the drawer unit to a closed position within the housing, wherein a third supporting unit moves the second end of the second supporting unit from the first position to the second position, when the drawer unit moves from the open position to the closed position;
feeding the rolled print medium supported on the first supporting unit and the second supporting unit to a printing unit; and
printing on a print medium fed from the rolled print medium supported by the first supporting unit and the second supporting unit.

16. The method of claim 15, wherein moving the drawer unit to the closed position further comprises:
passing the third supporting unit, for the rolled print medium, through an opening formed in the drawer unit.

17. The method of claim 15, wherein feeding the print medium supported on the first supporting unit and the second supporting unit to the printing unit comprises:
rolling the print medium on the first supporting unit and second support unit while clear of the third supporting unit.

18. The method of claim 15, wherein printing further comprises:
printing on a front surface and a back surface of the print medium.

19. The method of claim 18, wherein printing on the front surface is performed by an inkjet head and printing on the back surface of the print medium is performed by a thermal head.

20. The method of claim 15 wherein moving the drawer unit to the closed position within the housing further comprises:
lifting the rolled print medium above a top plane of the drawer unit when the rolled print medium is within the housing.

* * * * *